United States Patent [19]

Sengewald

[11] Patent Number: 4,889,523

[45] Date of Patent: Dec. 26, 1989

[54] TEARABLE PACKAGE OF SYNTHETIC THERMOPLASTIC FOIL AND DEVICE AND METHOD FOR PRODUCING THE SAME

[76] Inventor: Karl-Heinz Sengewald, Postfach 1460, 4802 Halle in Westf. 1 DE, Fed. Rep. of Germany

[21] Appl. No.: 159,722

[22] Filed: Feb. 24, 1988

Related U.S. Application Data

[60] Division of Ser. No. 897,843, Aug. 18, 1986, which is a continuation of Ser. No. 678,010, Nov. 30, 1984, abandoned.

[30] Foreign Application Priority Data

Dec. 8, 1983 [DE] Fed. Rep. of Germany ..... 3344332
Mar. 9, 1984 [DE] Fed. Rep. of Germany ..... 3408722

[51] Int. Cl.[4] ..... B31B 23/22; B31B 27/14; B31B 23/86

[52] U.S. Cl. ..... 493/195; 493/198; 493/235; 493/926; 493/930

[58] Field of Search ..... 493/194, 195, 198, 235, 493/239, 926, 930

[56] References Cited

U.S. PATENT DOCUMENTS

| | | | |
|---|---|---|---|
| 3,008,569 | 11/1961 | Murch | 224/42.46 R |
| 3,114,299 | 12/1963 | Entzminger | 493/239 |
| 3,385,428 | 5/1968 | Kugler | 206/554 |
| 3,390,617 | 7/1968 | Cloud et al. | 493/194 |
| 3,468,470 | 9/1969 | Sengewald | 383/120 |
| 4,500,307 | 2/1985 | Bridgeman | 493/196 |

FOREIGN PATENT DOCUMENTS

| | | | |
|---|---|---|---|
| WO84/00322 | 2/1984 | PCT Int'l Appl. | 493/194 |

*Primary Examiner*—Frederick R. Schmidt
*Assistant Examiner*—William E. Terrell
*Attorney, Agent, or Firm*—Michael J. Striker

[57] ABSTRACT

A package includes an upper wall, a lower wall and two side folds provided with folds. A tearable flap is provided at a filling opening of the package. The flap is provided with two suspension openings spaced from each other. The packages are produced from a web of synthetic thermoplastic foil which is formed into an envelope open at one longitudinal edge and side folds are thereafter formed on the envelope which is then weld-sealed at its open edge.

2 Claims, 4 Drawing Sheets

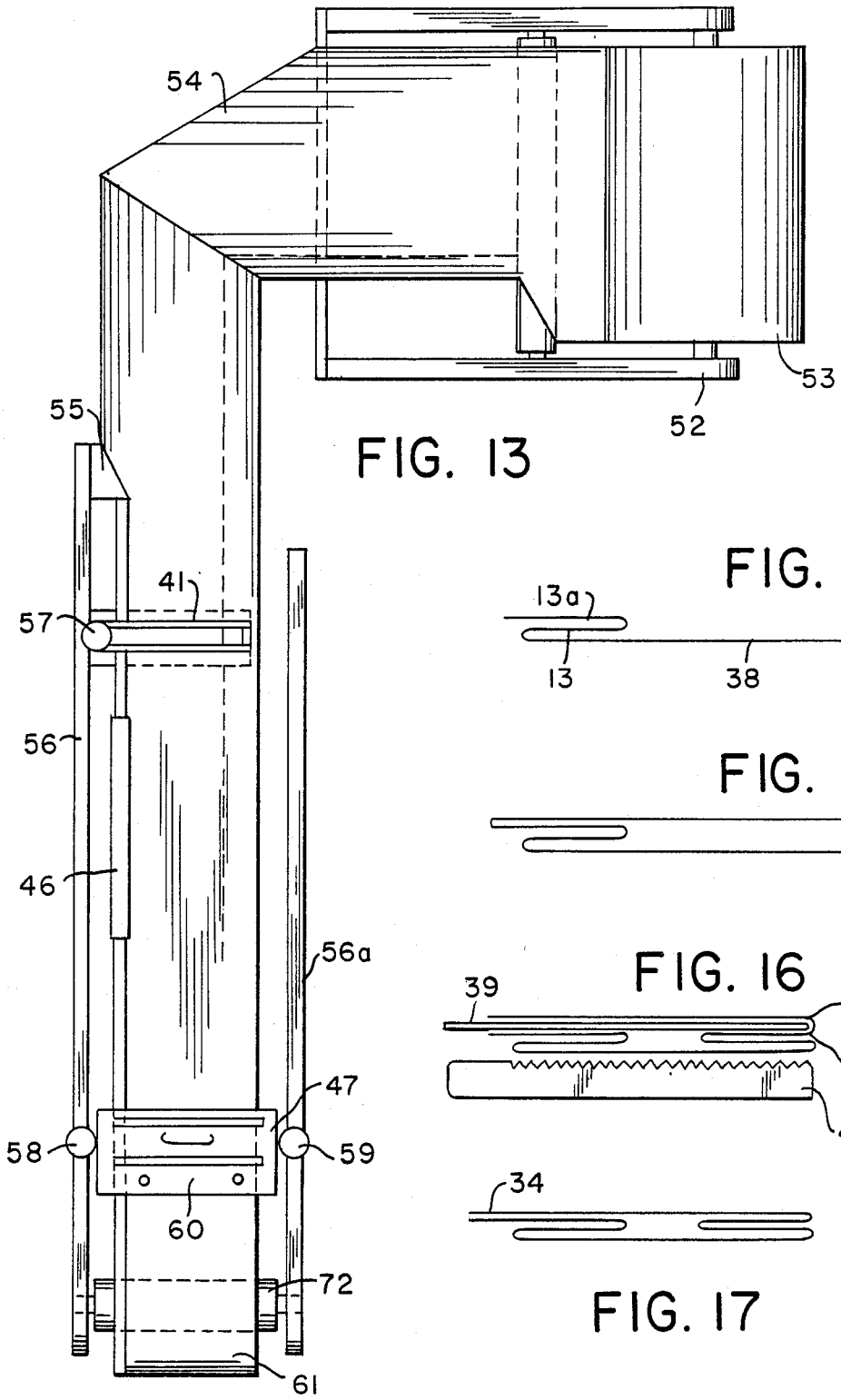
FIG. 13
FIG. 14
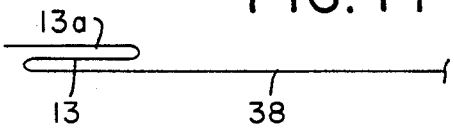
FIG. 15
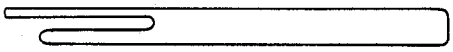
FIG. 16
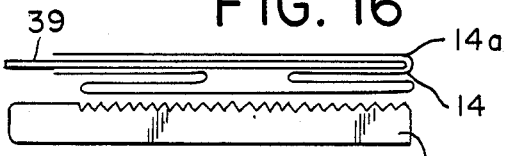
FIG. 17

TEARABLE PACKAGE OF SYNTHETIC THERMOPLASTIC FOIL AND DEVICE AND METHOD FOR PRODUCING THE SAME

This is a division of application Ser. No. 897,843, filed Aug. 18, 1986, which is a continuation of application Ser. No. 678,010, filed on Nov. 30, 1984, abandoned.

BACKGROUND OF THE INVENTION

The present invention relates to a package made of synthetic thermoplastic foil and provided with a tearable-off upper flap. More, particularly, the invention relates to the package, in the upper flap of which suspension openings are provided.

Tearable packages with a single upper flat, which have been known in the art, usually have a lateral seam and have been produced from a flat foil web or sheet by forming first a laterally open hose in which the edge of one foil layer has been extended over the edge of the opposite foil layer, whereby an upper flap has been formed. It is also possible to cut out the valve from the layers offset in the longitudinal direction. In the lateral open hose produced in such fashion one wall is wider than another wall. The packages are provided with transverse weld seams in connection with separation cuts. In such packages or containers it is possible and often customarily to form folds on the bottom wall lying opposite to the open side of the package, before providing transverse weld seams and separation seams. Packages with bottom folds and with the upper flaps have, however, only limited filling volumes. These packages are not suitable for packing such goods as napkins with great volumes. Packages of great volumes are provided only with side folds. The disadvantage of such packages resides in the fact that they are not provided with upper flaps so that an automatic filling of such packages is difficult. Packages with flaps are advantageous for the filling of the packages because during the filling process the packages are held on these flaps. For this purpose suspension openings are provided in the flaps. Packages or containers with single flaps has the advantage that they can be easily hung at those openings and the filling opening of the package is freely accessible. The packages with flaps are easy to open because both foil layers, which limit the filling opening of the package, are arranged at different levels.

Packages or containers of the forgoing type are disclosed in applicant's copending applications 171,140; 540,606 and 664887.

SUMMARY OF THE INVENTION

It is an object of the present invention to provide an improved package or container with a tearable flap.

It is another object of the invention to provide a package of synthetic thermoplastic foil with an upper flap and suitable for great filling volumes.

These and other objects of the invention are attained by a tearable package of synthetic thermoplastic foil, comprising a package body and an upper flap said package body being formed with side folds at both sides thereof.

The container or package of this invention is provided with the flap and also the side folds. The advantage of this package is its considerably great filling volume.

The package may have a filling opening and an edge in the proximity of said filling opening, said suspension openings being formed near said edge, said flap being further formed with cuts each spaced from an associated suspension opening by a foil web material. The suspension openings therefore can be easily provided in the flap. A further advantage of the package is that is can be easily filled because a sufficient distance is available between the filling opening and the holding pins which are normally engaged in the suspension openings. Moreover, the package can be suspended on the flap by holding elements without using the suspension openings.

The package body has an upper wall and a lower wall, said side folds being formed between said upper and lower wall, said flap being formed by a cutoff from said upper wall and said side folds.

The flap may have a tearing perforation at the level of said filling opening. Therefore simultaneously with a cutting-off operation the tearing perforation can be made on the flap. The bag can be later separated from the flap at that perforation, particularly after the filling process has been completed.

The package body and the flap may be formed of a flat sheet, said package body having elongated edges at one side thereof, said edges being connected to each other by a weld.

The package body may have at an end thereof opposite to said flap two parallel transverse weld seams, and a gripping opening formed between said parallel weld seams.

The objects of the invention are further attained by a device for producing a package of synthetic thermoplastic foil and including a package body and an upper flap, and in which the package body has side folds at the sides thereof, the device comprising means for forming a hose having a bottom wall, an upper wall and side folds therebetween; a supporting table for supporting said hose thereon; and a U-shaped punching cutter for punching away a portion of said upper wall and portions of said said folds to form said flap.

The punching cutter may have a portion provided with saw tooth-like cutting edges.

The device may further include a supporting plate insertable between the lower wall and the side folds and cooperating with said punching cutter.

The punching cutter may be of U-shape and have two elongated legs and one shorter transverse leg therebetween, said punching cutter being positioned over the hose to be cut so that its elongated legs extend transversely of the elongation of the hose, said shorter leg being positioned closely to a longitudinal edge of the hose which is opposite to a laterally open edge of the hose.

The device may further include a plate carrying two welding bars spaced from each other, a punch cutter for punching out a gripping opening in the flap, and two punching pins for punching out suspension openings in said flap.

The objects of the invention are further attained by a method, comprising the steps of supplying a flat foil sheet material; forming from said material a laterally open hose which has two longitudinal edges at an open side thereof, an upper wall and a lower wall; forming side folds at both sides of the hose; cutting a portion of said upper wall and portions of said side folds away from said lower wall to form the flap; and welding said two longitudinal edges to each other. In this method a supporting plate cooperating with the cutter can be inserted laterally into the hose.

Furthermore, in the proposed method in one working process with welding of the longitudinal edges to each other the following steps can be carried out:

(a) forming of two parallel transverse weld seams on said upper and lower walls;

(b) forming a gripping opening between said transverse weld seam; and (c) providing suspension openings in the flap.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWINGS

FIG. 13 is a schematic side view of the device for manufacturing the package of the invention; and FIGS. 14 through 17 schematically show the package at different stages of its manufacturing according to a modified making process.

DETAILED DESCRIPTION OF THE PREFERRED EMBODIMENTS

Figure 1:
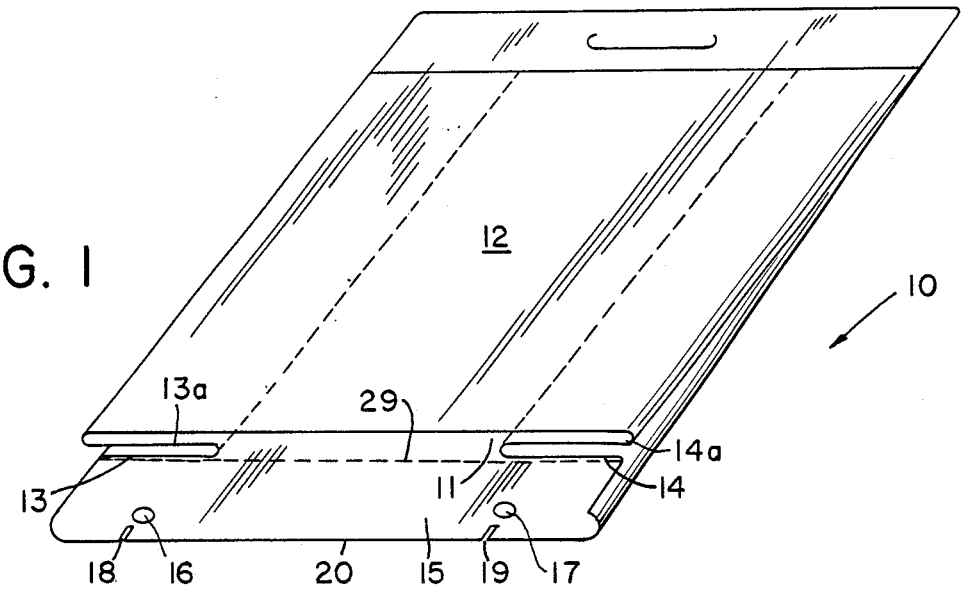
FIG. 1 is a perspective view of a package with an upper flap.

Referring now to the drawings in detail, and firstly to FIG. 1 thereof, a bag or package 10, which is made of thermoplastic synthetic foil, is formed of a bottom wall 11 and upper wall 12 which are connected integrally to each other into one-piece package at two opposite sides thereof by side folds 13, 13*a* and side folds 14, 14*a*.

An upper flap 15 which is formed as an extension of bottom wall 11 has two suspension openings 16 and 17 which are spaced from each other. Openings 16 and 17 are provided in the proximity of or at a small distance from respective cuts 18 and 19 which are made at a front edge 20 of the package.

Flap 15 is formed in a simple fashion by cutting the upper wall 12 and two oppositely positioned foil layers of the side folds 13, 13*a* and 14, 14*a* away from the lower wall 11 to provide an exposed portion of the latter which would form the flap 15.

Figure 2:
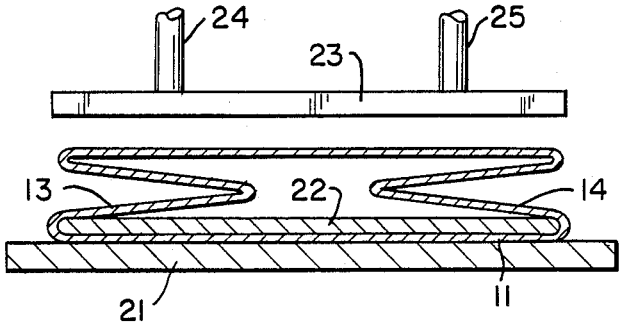
FIG. 2 is a sectional view of the package placed on a supporting table.

FIG. 2 illustrates a device for producing the aforementioned cutting-away. This device includes a supporting table 21 on which the bag is placed with its lower wall 11. A cutting support 22 is positioned between the upper surface of lower wall 11 and lower folds 13 and 14 integrally connected with wall 11. A punching knife 23, placed against the upper wall 12 of the bag, cooperates with the support 22 to produce a cut and therefore flap 15. Punching knife 23 is guided to and from cutting support 22 by two struts or stamps 24 and 25.

Figure 3:
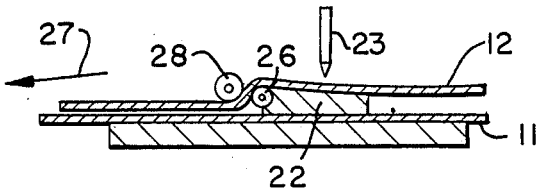
FIG. 3 is a partial sectional view illustrating a process of making a package.

With reference to FIG. 3 it will be seen that the cutting support 22 is provided with a roller 26 which cooperates with a counter roller 28 with the interposition therebetween of the foil strip forming the upper wall 12 when the hose constituting the package is moved in the direction of arrow 27. Thereby a support within the hose is provided.

Referring back to FIG. 1 it is seen that upper flap 15 has in the region of filling opening of the package a transverse perforation 29 which serves the purpose of the further separation of the flap from the package. Flap 15 is separated from the package after the latter has been filled with a commodity.

Figure 4:
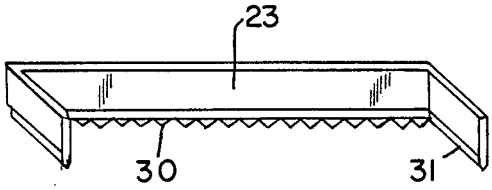
FIG. 4 is a perspective view of a punch cutter.

FIG. 4 shows the aforementioned punching knife in a perspective view. This knife has a U-shape cross-section and is provided on its side, extended transversely to the elongation of the package or the hose for producing the package, saw tooth-like cutting edges 30 which cut the portions of upper wall 12 and folds 13, 13' and 14, 14' away to expose flap 15 as described above. Perforations 29 are also produced by saw teeth 30 whereas a U-shaped cut is made by overlaying cutting edges.

Figure 5:
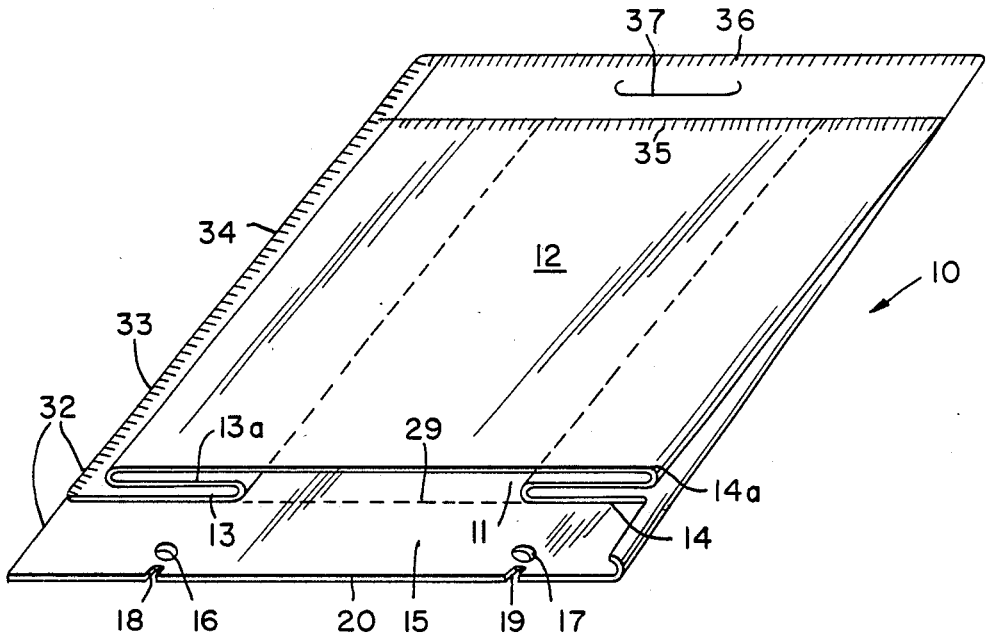
FIG. 5 is a perspective view of the package with an upper flap produced by the method of the invention.

FIG. 5 shows a finished package 10 in the perspective view. This package is manufactured from a flat web or sheet of which an envelope or a half hose is made and then two opposite longitudinal edges of this half hose or open hose are connected to each other by a longitudinal weld seam 34. Transverse parallel weld seams 35 and 36 are made to connect upper wall 12 with side folds 13, 13', 14, 14' and lower wall 11 and define the end of the package. A gripping opening 37 is punched out between seams 35 and 36.

Figure 6:
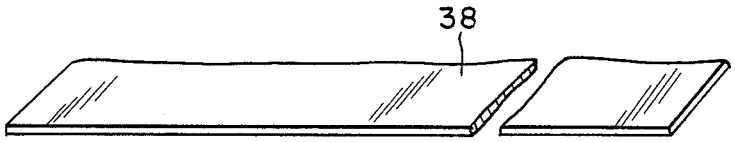
FIGS. 6 through 12 illustrate perspective views of the package of various stages of its manufacturing.
Figure 7:
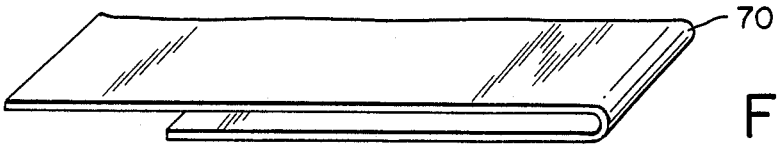
Figure 8:
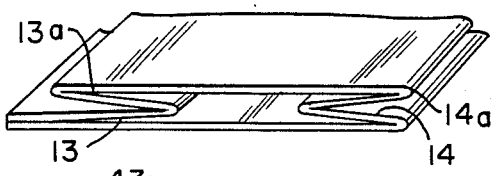
Figure 9:
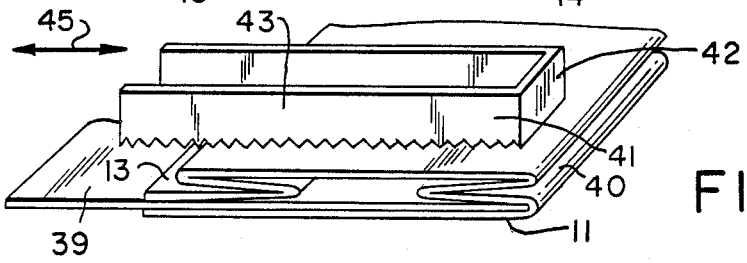
Figure 10:
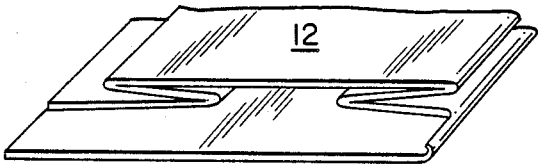
Figure 11:
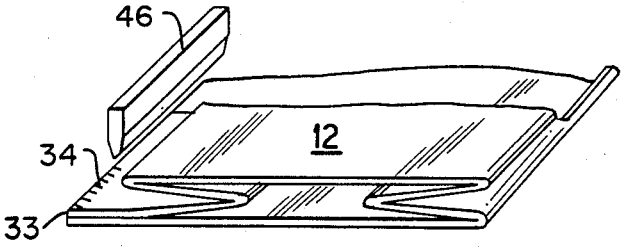

FIG. 6 shows a flat web or sheet 38 of thermoplastic synthetic foil, and FIGS. 7–12 shows successive stages of producing a package of the invention from it. The flat web 38 is folded over in the region of its central longitudinal axis to form a laterally open hose 70 as shown in FIG. 7. Then side folds 13, 13*a* are produced at one side of the upper portion of the laterally open hose 70 and side folds 14, 14*a* are produced at its other side as shown in FIG. 8. FIG. 9 shows the insertion of the counter cutting support 39 laterally between the lower folds 13 and 14 and the foil layer forming the lower wall 11. Counter cutting support 39 which inserted extends up to the longitudinal edge 40 of the package being formed. A cutter 41 of the U-shaped configuration cooperates with support 39. Cutter 41 extends transversely of the package over the width of the laterally open hose 70. A shorter leg of U-shaped cutter 41 extends approximately up to the longitudinal edge 40. This shorter leg as well as longer legs 43 and 44 of the cutter can be provided at their undersides with saw tooth-like cutting edges. Cutter 41 is reciprocally moved in the direction of arrows 45 syncronously with the forming of the package to make a cut for separating portions of upper wall 12 and the side folds from the lower wall 11 and produce flap 15 as seen in FIGS. 10 and 11. The longitudinal edges 32 and 33 are then welded to each other by seam 34 which is formed by a welding bar 46.

Figure 12:
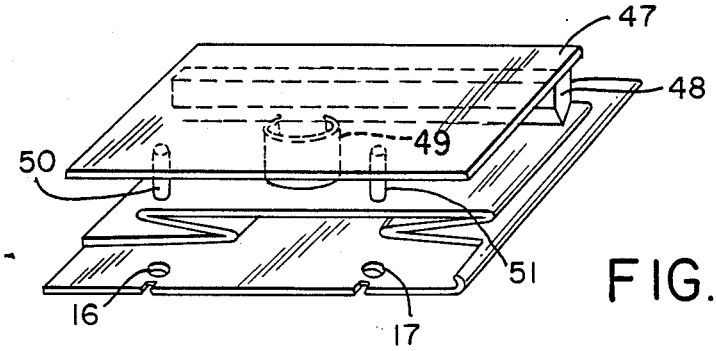

The transverse weld seam 35 is produced by means of a welding bar 48 supported on a supporting plate 47 as shown in Fig. 12. Simultaneously a punching cutter 49 connected to the plate 47 produces a gripping opening 37, shown in FIG. 5, at the end of the package opposite to flap 15. Punching pins 50 and 51 attached to plate 47 in turn form openings 16 and 17 in the upper flap 15. Thus, due to the provision of the supporting plate 47 with welding bar 48, cutter 49 and punching pins 50, 51, transverse weld seam 35, openings 16, 17 and opening 37 can be made simultaneously. By providing an additional welding bar on plate 47 the transverse weld seam 36 can be also made in one step with seam 35.

Reference is now made to FIG. 13 which schematically shows a device for forming packages of the above described construction. This device includes a roll-supporting or unrolling stand 52 on which a foil supply roll 53 for supplying flat web 38 is supported. Side folds 14, 14 are laid in also in connection with the unrolling stand. Then the flat web 38 is folded over a folding rectangular portion 54 of a machine frame 61 to form a laterally open hose. Then by a format blade 55 connected to a machine frame portion 56 side folds 13, **13*a* are formed. The counter cutting support 39 is connected to the machine frame portion 56. Cutter 41 is also supported on this frame portion 56 and is reciprocally moved by a piston-cylinder arrangement 57** synchronously with the forming of a package.

Plate 47 is connected to the machine frame portions 56, **56*a* via a piston-cylinder arrangement 58, 59. Plate 47 carries the welding bar 60 for making the transverse weld seam 36**. This welding bar can also be provided with a separating cutter which would cut the produced package from the remaining hose.

In the embodiment shown in FIG. 13 a cutter for separating finished packages from the hose is not provided instead the hose with finished packages is wrapped around a roll 72. To separate individual packages from the remaining hose it is sufficient to make a cut in the vicinity of weld seam 36 or also, if no weld seam 36 is formed, to make a combined weld and separating cut.

FIG. 14 schematically shows that, firstly, on one side of flat web 38 both side folds 13, **13*a* are formed. Then web 38 is folded over to form an envelope or laterally open hose as shown in FIG. 15. Thereafter side folds 14, 14*a* are formed as shown in FIG. 16. The counter support 39 is inserted between the upper wall of the hose and the adjacent folds while the punching cutter 41 is applied to the folded hose from below as seen in FIG. 16. The provision of the longitudinal weld seam 34 as well as the formation of transverse welds 35, 36 and gripping opening 37 and openings 16, 17 in flap 15** are carried out thereafter.

It will be understood that each of the elements described above, or two or more together, may also find a useful application in other types of tearable packages synthetic thermoplastic foil differing from the types described above.

While the invention has been illustrated and described as embodied in a tearable package of synthetic thermoplastic foil, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various application without omitting features that, from the standpoint of prior art, fairly constitute essential characteristics of the generic or specific aspects of this invention.

What is claimed as new and desired to be protected by Letters Patent is set forth in the appended claims.

We claim:

1. A method of manufacturing a tearable package of synthetic thermoplastic film, comprising the steps of providing semi-hose having two longitudinal edges of which one of the longitudinal edges is initially closed and the other of the longitudinal edges is initially open, upper and lower walls and plural folds provided at each of said longitudinal edges and connecting said upper and lower walls; moving said semi-hose over a cutting support extending laterally through said open edge; cutting one of said upper and lower walls and said plural folds by a cutting tool by using a cutting tool having a first blade and a second blade extending transversely to said longitudinal edges and being interconnected at one end averted from said open edge by a third blade extending in parallel to said longitudinal edges, so that said one wall become longer than the other wall and said plural folds and forms a flap; and connecting said upper and lower walls with one another so as to form a bottom.

2. A device for producing a package of synthetic thermoplastic foil from a semi-hose having two longitudinal edges of which one of the longitudinal edges is initially closed and the other of the longitudinal edges is initially open, upper and lower walls, and side folds at each of the longitudinal edges connecting the upper and lower walls, the device comprising cutting means for cutting one of said upper and lower walls and said plural folds and including a cutting tool having a first blade and a second blade extending transversely to said longitudinal edges and interconnected at one end averted from said open edge by a third blade extending in parallel to said longitudinal edges, so that said one wall becomes longer than the other wall and said plural folds and forms a flap; and means for connecting said upper and lower walls with one another so as to form a bottom.

* * * * *